United States Patent [19]

Matsumoto

[11] 4,195,583

[45] Apr. 1, 1980

[54] RELEASING MECHANISM FOR CAM FOLLOWERS IN A ZIGZAG SEWING MACHINE

[75] Inventor: Setsuo Matsumoto, Utsunomiya, Japan

[73] Assignee: The Singer Company, New York, N.Y.

[21] Appl. No.: 899,444

[22] Filed: Apr. 24, 1978

[51] Int. Cl.[2] ..... D05B 3/02

[52] U.S. Cl. ..... 112/158 A

[58] Field of Search ..... 112/158 R, 158 A, 158 B, 112/158 E, 158 F, 158 D; 335/272, 228, 189, 68; 74/54, 567

[56] References Cited

U.S. PATENT DOCUMENTS

| | | | |
|---|---|---|---|
| 3,092,762 | 6/1963 | Rotere et al. | 335/272 |
| 3,481,291 | 12/1969 | Schilling | 112/158 R X |
| 3,724,282 | 4/1973 | Daman | 112/158 A X |
| 3,820,485 | 6/1974 | Bradus et al. | 112/158 A |
| 3,874,312 | 4/1975 | Cook et al. | 112/158 E X |
| 3,929,081 | 12/1975 | Ketterer | 112/158 E |
| 4,066,029 | 1/1978 | Suchsland et al. | 112/158 E |
| 4,112,858 | 9/1978 | Kakinuma et al. | 112/158 E |

*Primary Examiner*—Werner H. Schroeder
*Assistant Examiner*—Andrew M. Falik
*Attorney, Agent, or Firm*—Robert E. Smith; Edward L. Bell

[57] ABSTRACT

An electrically actuated cam follower retracting mechanism is disclosed for facilitating cam selection in a zigzag sewing machine. By means of a rotary solenoid energized in response to the initial movement of a manual cam selector member, the cam followers are automatically retracted from tracking relation with the pattern cams so as not to interfere with cam selection. Provision is disclosed for releasing the needle bar from its drive and for retracting special cam followers. The retracting mechanism is latched into effective position and the solenoid is deenergized when retraction is complete. The latch is released when operation of the sewing machine is resumed after the new selection has been made.

8 Claims, 6 Drawing Figures

RELEASING MECHANISM FOR CAM FOLLOWERS IN A ZIGZAG SEWING MACHINE

BACKGROUND OF THE INVENTION

Mechanisms are known for mechanically retracting cam followers from tracking relation with pattern cams incident to pattern selection. These known mechanisms include retractors which respond to a control element which must be manually operated separately from the pattern selector element, and control elements which are associated with and operated manually simultaneously with the operation of the pattern cam selector. Such known follower retraction mechanisms suffer the disadvantages that either they require appreciable added effort on the part of the machine operator and thus increase the difficulty of pattern selection, or they require such appreciable lost motion to be included in the selector system in order to provide time for the retraction of the followers that they materially decrease the number of pattern cam choices which are available as a practical matter.

SUMMARY OF THE INVENTION

It is an object of this invention to provide for cam follower retraction as an incident of cam selection without burdening the machine operator and without limiting the pattern choice in any way.

This object of the invention is attained by providing an electrically operated follower retracting mechanism which responds automatically to an initial movement of the operator influenced pattern selector element.

Provision is made in this invention for retracting many different cam followers for releasing the needle bar, and for latching the release device in effective position so as to minimize the duty cycle of the solenoid or other electrical actuator which accomplishes the follower retraction.

DESCRIPTION OF THE DRAWINGS

The accompanying drawings illustrate a preferred form of this invention in which.

DETAILED DESCRIPTION OF THE INVENTION

Figure 1:
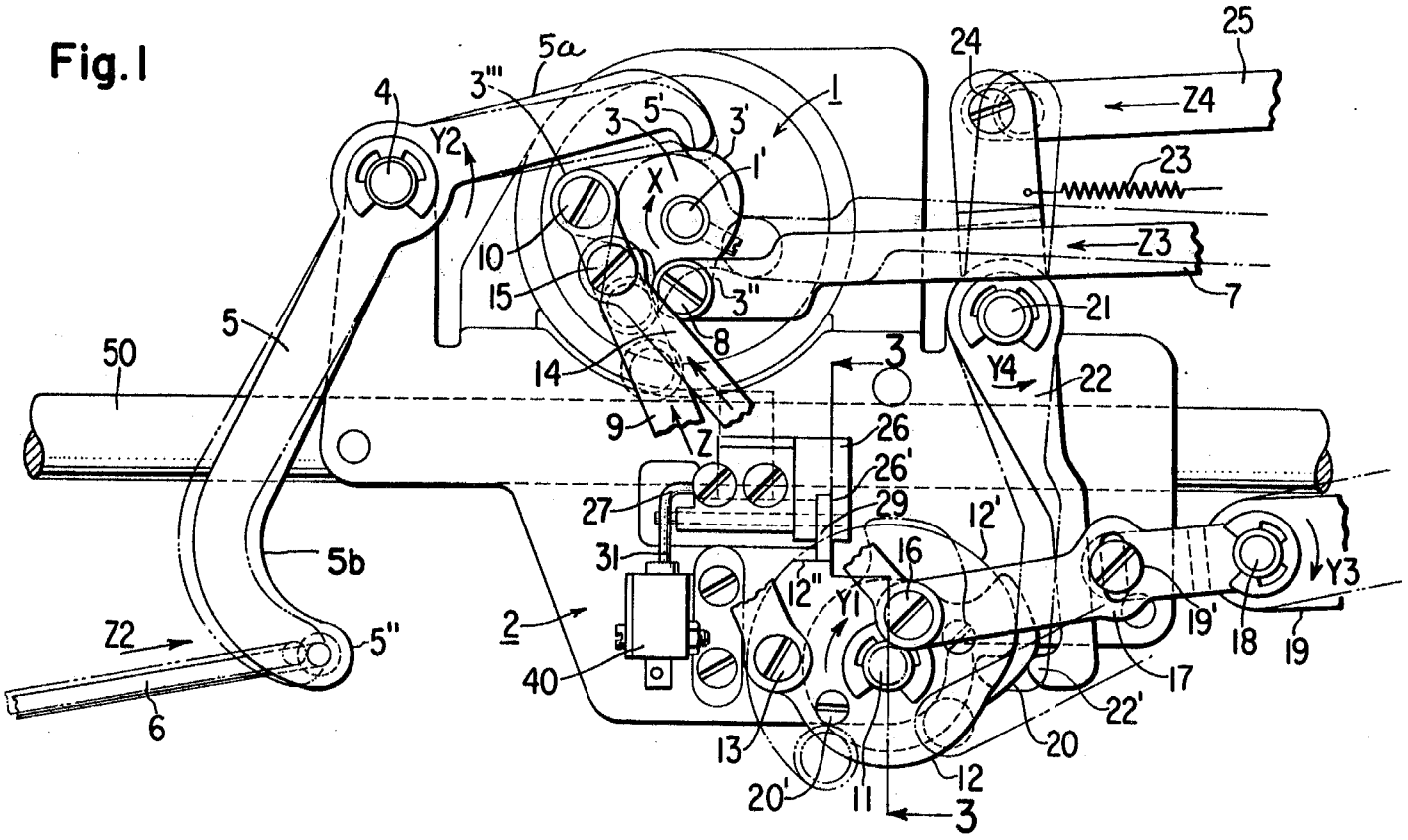
FIG. 1 represents a plan view of the device embodying the invention.
Figure 2:
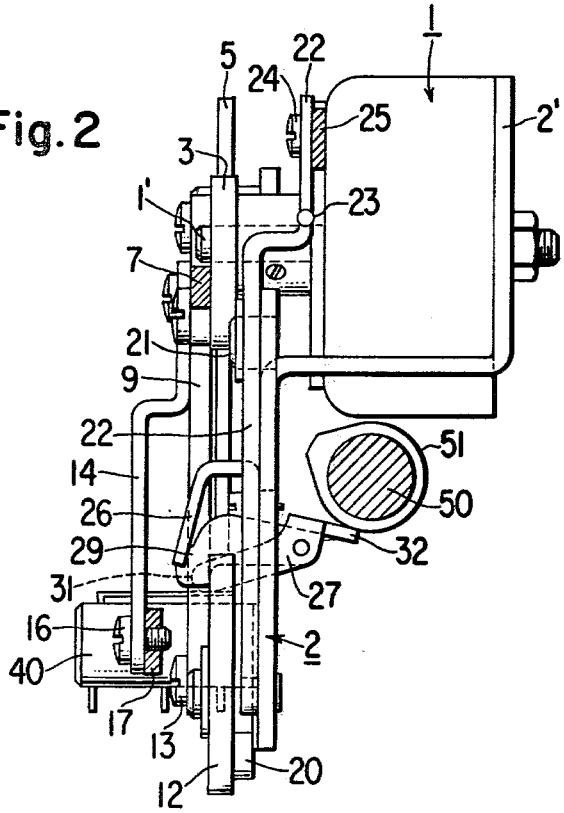
FIG. 2 is a right side view of FIG. 1.

With reference to the accompanying drawings, the following is a detailed description of a preferred embodiment of this invention.

An electro-magnetic rotary solenoid (1) is fixedly mounted on a mounting seat (2') of a bracket (2) fastened to the inside of a sewing machine arm. The rotary solenoid (1) carries a stud shaft (1') to which is affixed a crank (3). The solenoid crank (3) is formed with an eccentric cam surface (3') and two arms, (3'') and (3'''). An end (5') of the first arm lever 5*a* of a two armed needle bar releasing lever 5 freely pivoted at its center on a pin (4) provided in the bracket (2), is constantly in contact with said cam surface (3'). An end (5'') of the second arm lever 5*b* of the needle bar releasing lever (5) is pivotally connected to the end of a connecting rod (6) which extends to be linked to a needle bar releasing mechanism (not shown in the drawings). For further details of the sewing machine, the cam stack, and the followers, reference may be had to U.S. Pat. No. 3,795,210, dated Mar. 5, 1974 to Adams et al and assigned to the assignee of the instant application.

Pivotally connected to the arm (3'') of the solenoid crank (3) with a hinge screw (8) is one end of a link (7), the other end of which is connected to a zig zag disc follower (not shown). One end of another link (9) is pivotally connected to the arm (3''') of the solenoid crank (3) with a hinge screw (10), the other end of said link (9) being pivotally fastened with a hinge screw (13) to a kick-out lever locking plate (12) which is freely pivoted on a stud shaft (11) fixed to the bracket (2). One portion of the periphery of the kick-out lever locking plate (12) is formed with a cam (12') concentric to the stud shaft (11). The kick-out lever locking plate (12) is also formed with a notch (12'') at one portion of its periphery. The link (9) is pivotally connected to another link (14) by a hinge screw (15) in the vicinity of the hinge screw (10). The link (14) is pivotally connected at its other end to a feed releasing lever regulating plate (17) with a hinge screw (16), said plate (17) being rotatably fastened at its other end to a stud (18) fixed to the sewing machine arm. A feed releasing lever (19) is also rotatably fastened to the stud (18) at the point near its one end. One end of said feed releasing lever (19) is pivotally connected to a feed releasing lever regulating plate (17) with a screw (19') (see the drawings), with the other end connected to a feed follower guide bracket (not shown).

Figure 4:
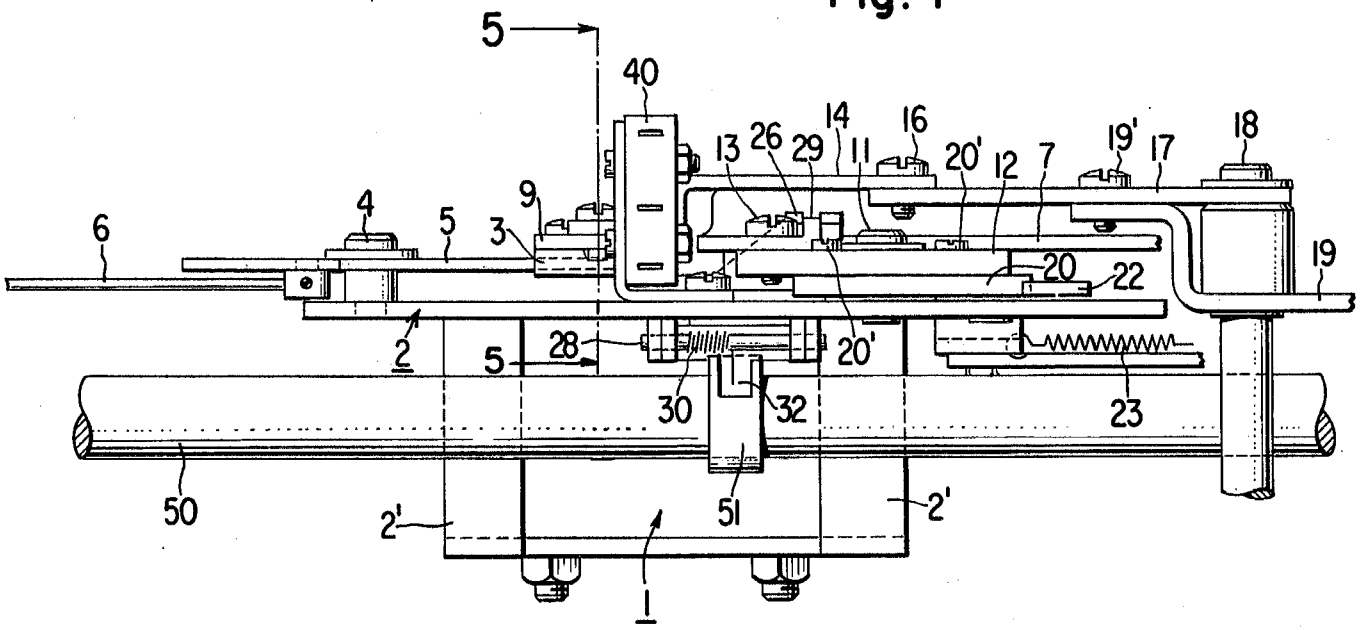
FIG. 4 is a front view of FIG. 1.

A needle position releasing cam (20) having an outwardly inclined ramp portion on its periphery is freely pivoted on the stud shaft (11) provided in the bracket (2), however, said cam (20) is secured to the kick-out lever locking plate (12) by a set screw (20'). (See FIG. 4) One end (22') of a two armed needle position releasing lever (22) which is pivoted at its center on a stud shaft (21) secured to the bracket (2), constantly presses against the needle position releasing cam (20) by virtue of a spring (23) provided in the vicinity of the other end of the needle position releasing lever (22). The other end of the needle position releasing lever (22) is pivotally connected to one end of a link (25) by a hinge screw (24). Incidentally, the other end of the link (25) is connected to a needle position selector mechanism (not shown).

Figure 3:
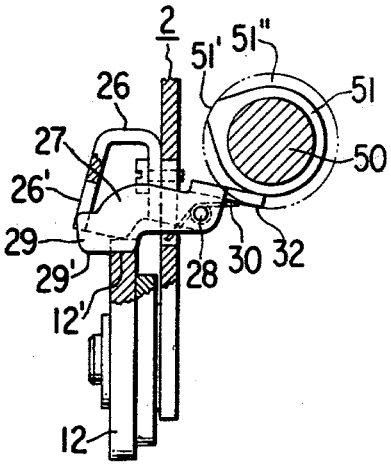
FIG. 3 is a cross sectional view taken substantially on the line 3—3 in FIG. 1.
Figure 5:
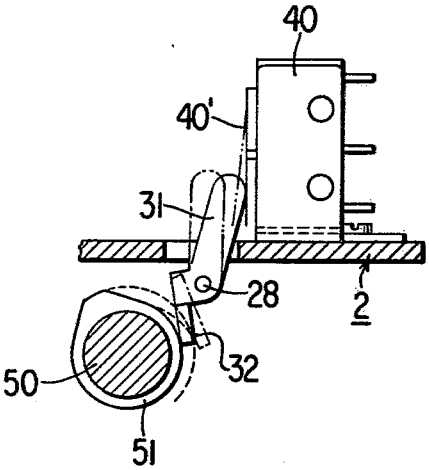
FIG. 5 is a cross sectional view taken substantially on the line 5—5 in FIG. 4.

As illustrated in FIGS. 1 and 3, the bracket (2) carries a kick-out lever bracket (26) having a guide slot (26'). A kick-out lever (27) is pivotally supported on the kick-out lever bracket (26) by a pin (28), and a locking lever (29) formed at one end of the kick-out lever (27) slidably engages the guide slot (26') of the kick-out lever bracket (26). Also the end portion of the locking lever (29) constantly presses against the cam surface (12') of the kick-out lever locking plate (12) by virtue of a spring (30) fastened to a pin (20). The first arm lever (31) also provided on the kick-out lever (27) is disposed above a spring (40') of a normally closed micro-switch (40) fitted to the bracket (2) as illustrated in FIG. 5. Further, the kick-out lever (27) carries one more arm lever (32) (see FIG. 3) positioned at the periphery of a loading cam (51) secured to the arm shaft (50) of the sewing machine and having a highest lobe identified as (51') on its periphery.

Figure 6:
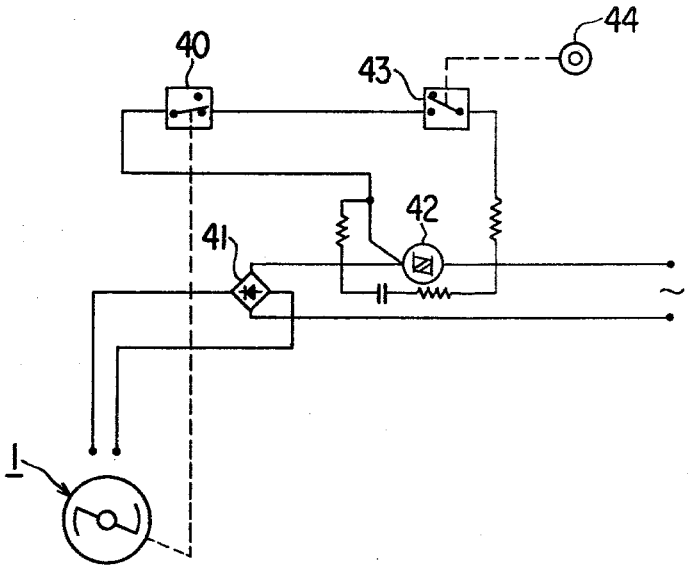
FIG. 6 represents a circuit diagram of this invention.

FIG. 6 is a circuit diagram showing an electrical arrangement suitable for the device of this invention. As shown in the diagram, the circuit provides means for providing an A.C. voltage from source (100V) to bridge rectifier which in turn supplies a full-wave rectified voltage to the electro-magnetic rotary solenoid (1). This control circuit is provided with two micro-switches, the normally closed micro-switch 40 previously described, and a normally open micro-switch 43 on the gate circuit for a triac (42), and when a pattern selector dial (44) located appropriately on the front side of the sewing machine, is depressed, it will cause the micro-switch (43) to be closed, thereby allowing current to flow into the solenoid (1).

OPERATION

The construction of the device of this invention is as far thus described and the operation thereof will now be explained below.

The pattern selector dial (44) (FIG. 6) located on front of the sewing machine must be depressed before it can be turned to effect a pattern selection, and depression of the dial 44 will close the micro-switch 43 supplying current to the solenoid (1) via the normally closed micro-switch 40. When actuated the solenoid shaft 1' will rotate by magnetic force. As the solenoid shaft (1') rotates, the solenoid crank (3) secured to the stud shaft (1') will also rotate in the X direction represented by the arrow shown in FIG. 1. (Phantom line indicates the solenoid crank (3) before action and full line indicates the solenoid crank (3) after action). This will result in the link (9) pivoted on the arm (3''') of the solenoid crank (3) moving toward the Z1 direction represented by the arrow shown in the drawing which in turn will cause the kick-out locking plate (12) to rotate in the Y1 direction. The end (29') of the locking lever (29) of the kick-out lever (27) presses against the control cam (12') of the kick-out locking plate (12) by virtue of a spring (30), and as the kick-out locking plate (12) is rotated in the Y' direction until the notch (12'') reaches the locking lever (29), the locking lever (29) will rotate about the pivot pin (28) by virture of a spring (30) and drop into the notch (12'').

On one hand, during the period in which current is supplied by the depression of the pattern selector dial (44), the kick-out locking plate (12) is rotated and the locking lever (29) drops into the notch (12''), the following actions will also taken place, that is, when the solenoid crank (3) is rotated, an end (5') of the needle bar releasing lever (5) which presses against the eccentric cam (3') of the solenoid crank (3) by virtue of a spring (not shown), will rotate on the stud (4) in the Y2 direction, pulling the connecting rod (6) which is fulcrumed on the other end (5'') of the needle bar releasing lever (5), in the Z2 direction and through said connecting rod (6) pull the needle bar releasing mechanism (not shown) in the Z2 direction, thereby operating upon the needle bar. The rod (6) may be connected to any known skip stitch mechanism for releasing the needle bar from its usual reciprocating drive connections. Simultaneously, the link (7) connected to the arm (3'') of the solenoid crank (3) by the pin (8) will also be rotated in the Z3 direction, pulling a zig zag cam follower (not shown) connected to the other end of said link (7) also in the Z3 direction, thereby releasing the zig zag cam follower from the zig zag cam. The link (7) may be connected to any known mechanism for retracting a zig zag cam follower from contact with the periphery of the pattern cam.

The feed releasing lever regulating plate (17) which is at its one end pivoted on the stud (18), is connected to the link (14) which extends to be connected to the link (9). Also the feed releasing lever (19) is connected to the feed releasing lever regulating plate (17) by a screw (19'). Consequently when the solenoid crank (3) is rotated in the X direction, the feed releasing lever (19) integrally constructed with the feed releasing lever regulating plate (17) will rotate about the stud (18) by way of the link (9) and (14) in the Y3 direction, thereby moving the feed follower away from the periphery of the feed cam. The lever (19) may be connected to any known mechanism for retracting a feed cam follower from contact with the periphery of the pattern cam.

The needle position releasing cam (20) is integrally constructed with the kick-out locking plate (12) and rotatably mounted on the stud (11). Consequently, as the kick-out locking plate (12) rotates in the Y1 direction, the needle position releasing cam (20) will also rotate in unison with the kick-out locking plate (12). Furthermore, the end (22') of the needle position releasing lever (22) having its fulcrum on the stud (21), presses against the cam (20) by virtue of a spring (23). Consequently, as the end (22') climbs up the inclined ramp portion of the cam (20), the opposite end of the needle position releasing lever (22) will be forced to rotate in the Y4 direction in opposition to the spring (3), pulling the link (25) connected thereto in the Z4 direction, thereby shifting a needle position cam follower or buttonhole cam follower out of contact with a needle position cam or buttonhole cam respectively. Any known retracting mechanism for a needle position cam follower or buttonhole cam follower may be connected to the link 25, or for that matter the releasing mechanism for any other special purpose cam follower.

As far thus described, it will be appreciated that four releasing actions namely, releasing of the needle bar, zig zag cam follower, feed follower and needle position control mechanism are accomplished. The arm lever (31) of the kick-out lever (27) which has on its other end the locking lever (29) engageable with the notch (12'') of the kick-out locking plate (12), will push a spring (40') of the micro-switch (40) where current was flowing, turning the micro-switch (40) from "on" to "off", thereby blocking the circuit. The solenoid (1) which has been rotated, is urged to return to its original position by virtue of the spring built therein, however, it is prevented from returning to its original position since the locking lever (29) of the kick-out lever (27) still engages the notch (12'') of the kick-out locking plate (12).

When the sewing machine is run to start sewing under the conditions as described above, the loading cam (51) having a high lobe on portion of its periphery and which is carried on the arm shaft (50) will rotate in unison with the arm shaft (50). As the loading cam (51) rotates, the high lobe (51') of the loading cam (51) will depress the arm lever (32) of the kick-out lever (27) in opposition to the pressure of the spring (30), allowing the locking lever (29) integrated with said arm lever (32) to be out of engagement with the notch (12'') of the kick-out locking plate (12). The arm lever (32) will then be brought into contact with the cam (12') which is concentric to the needle position releasing cam (12).

This will free the solenoid (1) which is connected to the kick-out locking plate (12) by way of the solenoid crank (3) and the link (9), therefore, the solenoid (1) will rotate in the direction opposite to the X direction and return to its original position indicated by phantom line, allowing the above-mentioned four mechanisms also to return to their original positions respectively. Thus, sewing operation is made possible by the continuous rotation of the arm shaft (50).

Having set forth the nature of this invention, what is claimed herein is:

1. In a zig zag sewing machine having a plurality of pattern cams designed to produce stitch patterns by selecting one of said pattern cams with a cam follower which moves responsive to both turning depression of a pattern selector dial, a releasing mechanism comprising an electro-magnetic rotary solenoid (1), said electro-magnetic solenoid (1) being arranged to be capable of being energized from outside power source by the depression of such pattern selector dial, and a means to activate a link (7) connected to a cam follower and also a feed releasing lever (17) connected to a feed follower mechanism concurrently when said solenoid (1) is energized, thereby releasing the cam and feed followers from the pattern cams.

2. In a releasing mechanism as set forth in claim 1 in which said electromagnetic solenoid (1) is arranged so that a link (25) connected to a needle position control mechanism and a connecting rod (6) connected to a needle bar releasing mechanism will be activated concurrently.

3. A releasing mechanism as set forth in claim 2 in which a solenoid crank (3) formed with an eccentric cam surface on its periphery is secured to a stud shaft (1') of said solenoid (1), and one end of a link (7) is pivotally fastened to said solenoid crank (3), the other end of said link (7) being connected to a cam follower, and in which a kick-out locking plate (12) freely pivoted on said bracket (2) is connected to said solenoid crank (3) by way of a link (9), and a kick-out lever (27) having an end (29) engageable with a notch (12'') formed on one portion of periphery of said kick-out locking plate (12), is pivotally fastened to said bracket (2), and in which said kick-out lever (27) is integrally constructed with a first arm lever (31) disposed above a spring (40') of a micro-switch (40) fixed to said bracket (2) and further said kick-out lever (27) is also integrally constructed with a second arm lever (32) which will be operated by a loading cam (51) secured to an arm shaft.

4. A releasing mechanism as set forth in claim 3 in which a needle bar releasing lever (5) which will be moved radially by said eccentric cam (3') formed on a solenoid crank (3) of said electro-magnetic solenoid (1), is pivoted on said bracket (2), and said needle bar releasing lever (5) is connected to a connecting rod (6) which extends to be linked to a needle bar releasing mechanism.

5. A releasing mechanism as set forth in claim 3 in which a needle position releasing cam (20) is integrally constructed with a kick-out locking plate 12, and a needle position releasing lever (22) which will be moved radially by said needle position releasing cam (20), is pivoted on said bracket (2) and in which said needle position releasing lever (22) is connected to a link (25) which extends to be linked to a needle position releasing mechanism.

6. A releasing mechanism as set forth in claim 3 in which a feed releasing lever (19) is pivotally fastened to a stud shaft (18), and also pivoted on said stud shaft (18) is one end of a feed releasing lever regulating plate (17) to which is secured one end of said feed releasing lever (19), the other end of said feed releasing lever regulating plate (17) being connected to one end of a link (14), and in which the other end of said link (14) is pivotally fastened to a portion of a link (9) which connects said electro-magnetic solenoid (1) to said kick-out locking plate (12).

7. A cam follower retracting mechanism for a zig zag sewing machine having a plurality of pattern cams designed to produce stitch patterns by selecting at least one of said pattern cams for tracking relation with at least one cam follower responsive to both turning depression of a pattern selector dial, said retracting mechanism comprising an electro-magnetic rotary solenoid with a shaft, means for mounting said solenoid in such machine, means for energizing said solenoid from an outside power source by the depression of such pattern selector dial, at least one link connected with such at least one cam follower and releasing means for activating said link when said shaft of said solenoid is rotated by such energization to thereby release the cam follower from tracking relation with the pattern cam.

8. In a releasing mechanism as set forth in claim 7 for use in a sewing machine within the plurality of pattern cams include at least one needle position cam having its cam follower connected with said link and at least one feed cam, further comprising a feed releasing lever connected with a feed follower mechanism associated with the feed cam, said feed releasing lever being also connected with said releasing means so that activation of said releasing means concurrently releases the feed follower from the feed cam.

* * * * *